US009839923B2

(12) United States Patent
Ramos De Barros

(10) Patent No.: US 9,839,923 B2
(45) Date of Patent: Dec. 12, 2017

(54) SHOWERHEAD

(71) Applicant: FABRIMAR S/A INDÚSTRIA E COMÉRCIO, Rio de Janeiro (BR)

(72) Inventor: Carlos Augusto Ramos De Barros, Rio de Janeiro (BR)

(73) Assignee: FABRIMAR S/A INDUSTRIA E COMERCIO, Rio de janiero-RJ (BR)

( * ) Notice: Subject to any disclaimer, the term of this patent is extended or adjusted under 35 U.S.C. 154(b) by 110 days.

(21) Appl. No.: 14/416,911

(22) PCT Filed: Aug. 2, 2013

(86) PCT No.: PCT/BR2013/000282
§ 371 (c)(1),
(2) Date: Jan. 23, 2015

(87) PCT Pub. No.: WO2014/019046
PCT Pub. Date: Feb. 6, 2014

(65) Prior Publication Data

US 2015/0196927 A1 Jul. 16, 2015

(30) Foreign Application Priority Data

Aug. 2, 2012 (BR) ..... 10 2012 019373
May 20, 2013 (BR) ..... 10 2013 012444

(51) Int. Cl.
*B05B 15/02* (2006.01)
*B05B 1/18* (2006.01)
(Continued)

(52) U.S. Cl.
CPC ..... *B05B 1/185* (2013.01); *B05B 1/18* (2013.01); *B05B 1/3006* (2013.01);
(Continued)

(58) Field of Classification Search
CPC . B05B 15/02; B05B 15/0208; B05B 15/0216; B05B 15/0225; B05B 15/0233; B05B 1/18; B05B 1/185; E03C 2201/70
(Continued)

(56) References Cited

U.S. PATENT DOCUMENTS 1,236,617 A * 8/1917 Speakman ..... B05B 15/0233 137/244
2,251,192 A * 7/1941 Krumsiek ..... B05B 1/3046 239/117
(Continued)

FOREIGN PATENT DOCUMENTS

GB 2251192 * 6/1989 ..... B05B 1/18
GB WO 2007141551 A1 * 12/2007 ..... B05B 15/0233

*Primary Examiner* — Alexander Valvis
(74) *Attorney, Agent, or Firm* — Abelman, Frayne & Schwab

(57) ABSTRACT

The showerhead has a hollow body (10) provided with an inlet nozzle (11) and with a sieve (C) perforated by holes (13) and a cleaning device (40) carrying a plurality of lower pins (41) and displaceable, in the interior of the hollow body (10), between an inoperative position, with the pins (41) spaced from the sieve (C), and an operative position, with each pin (41) introduced into one hole (13) of the sieve (C) and defining at least one water outlet with the hole (13). A driving element (50) is associated with the inlet nozzle (11) and is affixed to the cleaning device (40), in order to maintain it in the inoperative position, while the hydraulic pressure in the inlet nozzle (11) is less than a reference value and displacing the cleaning device (40) to the operative position, when the hydraulic pressure reaches the reference value. A biasing element (60) displaces the driving element (50) and the cleaning means (40) to the inoperative position, when the hydraulic pressure is lower than the reference value.

19 Claims, 11 Drawing Sheets

(51) Int. Cl.
*B05B 1/30* (2006.01)
*B05B 15/06* (2006.01)

(52) U.S. Cl.
CPC ..... *B05B 15/0208* (2013.01); *B05B 15/0233* (2013.01); *B05B 15/0241* (2013.01); *B05B 15/067* (2013.01); *E03C 2201/70* (2013.01)

(58) Field of Classification Search
USPC ..... 239/117, 118, 114–116; 4/606, 615
See application file for complete search history.

(56) References Cited

U.S. PATENT DOCUMENTS 5,718,380 A * 2/1998 Schorn ..... B05B 15/0233
239/117
6,736,336 B2 * 5/2004 Wong ..... B05B 1/1654
239/104

* cited by examiner

SHOWERHEAD

FIELD OF THE INVENTION

The present invention refers to a showerhead of the type to be installed in bathrooms of private, collective or public use, and presenting a hollow body which is associated with a water supply pipe and inferiorly closed by a perforated plate, defining the sieve of the showerhead and whose holes, for water passage, may be easily cleared from eventual impurities or clogs, by a simple manual operation of the user while using the showerhead, or automatically, by operation of the showerhead itself.

PRIOR ART

It is well known the problem related to the progressive accumulation of impurities and clogs in the holes of the sieve, which tend to reduce or even block the passage of water through said holes, reducing the amount of water released by the showerhead, compromising its operational performance and impairing the quality of the bath.

In many known constructions, the operation of cleaning and unclogging the sieve holes requires dismounting the showerhead, said operation being usually complex and time-consuming and effected with the aid of tools and with the showerhead out of operation, that is, it cannot be made during the bath and by means of simple and quick manual actuation of the user.

Other showerheads known in the art are provided with a cleaning device, which allows the user to displace, manually and during the bath, a frame internal do the body of the showerhead and which carries pins to be introduced, each one and in a relatively tight manner, into a respective hole of the sieve, in order to clean the latter. While allowing for a simple manual operation which can be carried out during the bath, said known solution presents the inconvenience of effecting the cleaning only by the simultaneous introduction of all the pins into the respective holes of the sieve of the showerhead, which holes present a reduced cross section area which becomes easily clogged. Thus, in case one of the holes of the sieve is blocked upstream by a particle of impurity seated thereon, not only the respective pin but also all the other pins will be impeded of penetrating in the holes of the sieve. In this situation, dismounting the showerhead is necessary, resulting in the inconveniences of this type of operation.

Some known showerhead constructive solutions present the function of automatic cleaning the sieve holes, which is carried out during operation of the showerhead.

In one of the known solutions, disclosed in Brazilian document PI9504809-0, the showerhead is provided with a cleaning device formed by an inner grid, affixed in the interior of the hollow body of the showerhead, above the sieve and incorporating a plurality de cleaning pins, turned downward and which are shaped and positioned to be individually inserted in the interior of a respective hole in the sieve of the showerhead, when the latter has its control valve turned off, that is, when the showerhead is brought to the off condition.

According to the construction of the document mentioned above, the sieve is rotatively affixed in the hollow body of the showerhead and axially displaceable between an active position, with the showerhead in the on condition, in which the through-holes of the sieve are kept spaced away from the cleaning pins of the inner grid, and a rest position, with the showerhead in the off condition, in which the holes of the sieve are fitted in the cleaning pins of the inner grid, promoting the cleaning and unclogging of the sieve holes. An elastic element, mounted in the interior of the hollow body, forces the sieve constantly to the rest position. However, when the showerhead is brought to the on condition, the hydraulic pressure, acting on the sieve, overcomes the resistance imposed by the elastic element, separating the sieve from the cleaning pins and clearing the sieve holes for the free water discharge upon operation of the showerhead.

Said known construction, although promoting the cleaning of the sieve holes, presents the drawback of maintaining the sieve visually retracted in the interior of the hollow body when the showerhead is in the off condition, making difficult to fully block the water remaining within the hollow body after the user turns off the showerhead after his bath. After the showerhead is turned off and, particularly, when it is found in an even slightly inclined position, the water retained therewithin cannot drain rapidly, due to the reduced diameter of the sieve holes, allowing the showerhead to undesirably drip water for a time, even after being taken to the off condition.

Another aspect of such known construction results from the reduced diameter (about 1 mm) of the sieve holes, which facilitates its obstruction by dirt. Any grain with a larger diameter will be clogged in one of the sieve holes and will not be removed by the cleaning pin, which may further impair the approximation of the sieve with all the cleaning pins of the inner grid, impeding the automatic cleaning operation to take place and leading to the need of making a troublesome dismounting operation of the sieve for its manual cleaning.

Other constructive solution is described in Brazilian document PI0300309-4, which comprises an unclogging device defined by a cleaning element incorporating a plurality of cleaning pins, turned downwardly and positioned to be, as a function of the operational conditions of the showerhead, inserted in or removed from the interior of the through-holes defined in the sieve of the showerhead.

According to the particular construction of PI0300309-4 mentioned above, the cleaning element, rotatively affixed in the hollow body of the showerhead, is axially displaceable in the interior of said hollow body, from an inoperative position, in which the cleaning pins are kept spaced away from the sieve holes, while the showerhead is in the on condition, that is, in the bath condition, and by actuation of the hydraulic pressure, exerted by the water flow, under a first moving element (diaphragm), coupled to the cleaning element, in order to overcome the resistance exerted by a second resilient moving element (spring), which constantly forces the cleaning element to an operative position, in which the cleaning pins are inserted, with a slight gap, in the sieve holes, thus remaining while the showerhead is in the off condition. The cleaning pins are conducted to the operative position when the showerhead is turned off, in order to provide the self-cleaning and/or the unclogging of the natural impurities, which are normally brought to the hydraulic supply pipe, wherefrom they flow to the through-holes of the sieve, upon operation of the showerhead in the on condition.

While providing the cleaning and unclogging of the through-holes of the sieve, aiming at maintaining the water flow defined in the showerhead project, said second solution also presents a sieve with holes of reduced diameter (about 1 mm), facilitating obstruction thereof caused by dirt. As already mentioned in relation to the other prior art document, grains with larger diameter tend to be trapped in the sieve holes, and cannot be removed by the cleaning pins, which can impair the approximation of the sieve to the inner cleaning pins, impeding the automatic cleaning function to be carried out and leading to the need of making a laborious disassembly of the sieve for its manual cleaning.

Besides the drawback mentioned above, said second known solution requires the provision of a diaphragm which, in case of undergoing a rupture, even small, will provoke leaks which, depending on the proportions and on the hydraulic supply pressure of the showerhead, may hinder the operation of the latter.

Another limitation, which is inherent to the second previous solution mentioned above, relates to the fact that it does not allow the user to utilize, by means of a simple manual operation during the bath, the pressurized water flow itself, being admitted in the hollow body of the showerhead, for carrying out an intense cleaning of the sieve holes, with the latter being totally freed from the pins of the cleaning means.

In all known solutions, having manual or automatic cleaning, the sieve holes present a reduced cross section, which facilitates obstruction and impairs the unclogging thereof, not only by the cleaning pins, but also by using the supply water flow itself, of the showerhead, for cleaning the holes and remove impurities therefrom. In said known solutions, the small sieve holes further facilitate the occurrence of continuous water drops after the showerhead is turned off.

SUMMARY OF THE INVENTION

Due to the inconveniences cited above and related to the solutions of the state of the art, it is an object of the present invention to provide a showerhead, with a robust and relatively simple construction and which allows an effective and easy unclogging operation to be effected on the sieve holes, either individually or jointly, through a simple manual operation of the user during the bath, or also automatically, by operation of the showerhead itself, with the use of the water flow passing through the sieve holes.

The invention further provides a showerhead as cited above, which presents a sieve capable of producing a pleasant bath sensation, with a relatively reduced water flow and with the sieve holes being difficult or even impracticable to be obstructed by the impurities eventually present in the supply water flow of the showerheads.

It is a further object of the present invention to provide a showerhead, as mentioned above and which presents a quick and full drainage of the sieve, eliminating the inconvenience of the showerhead dripping for a certain time, after turned off, even when the sieve is positioned rather inclined in relation to a horizontal plane.

The present showerhead has an automatic cleaning function, which comprises a phase of washing the sieve holes, upon the initial turning on of the showerhead, with said holes presenting a conveniently widened free cross section, and a phase of cleaning and adjusting the free cross section of said holes, upon the normal operation of the showerhead.

Besides the automatic cleaning function, the showerhead also presents a manual cleaning function, which allows the user to carry out, through a simple manual operation during the bath, an intense washing of the sieve holes with a widened cross section, when said holes are completely liberated by the pins of the cleaning element. The present showerhead is of the type which comprises a hollow body provided with an inlet nozzle, to be coupled to a water supply pipe, and with a lower wall defined by a sieve perforated by a plurality of holes.

According to the invention, the showerhead further comprises: a cleaning means mounted in the interior of the hollow body, carrying a downwardly projecting plurality of pins and being displaceable between an inoperative position, in which it maintains the pins spaced away from the holes of the sieve, and an operative position, in which each pin is introduced into a respective hole of the sieve, defining at least one, and preferably, a plurality of water outlets with said hole; a driving means, operatively associated with the inlet nozzle and affixed to the cleaning means, maintaining the latter in said inoperative position, while the hydraulic pressure in the interior of the inlet nozzle is inferior to a reference value, and displacing said cleaning means to the operative position, when said hydraulic pressure reaches the reference value; and an impelling means mounted in the interior of the hollow body and displacing the driving means and the cleaning means to the inoperative position, when said hydraulic pressure is inferior to the reference value.

The solution proposed by the present invention comprises the provision of a fixed sieve and of a movable cleaning means, but with the latter having its lower pins maintained spaced away from the sieve holes, while the showerhead remains turned off, and during an initial period in which the showerhead is turned on, allowing an initial flow of water to enter into the body of the showerhead and be directed to the sieve holes with a widened cross section, washing the latter, while they stay fully open, without any interference of the pins of the cleaning means.

By turning on the showerhead, the hydraulic pressure in its inlet nozzle rises, displacing the cleaning means to the operative position, in which its pins are inserted in the respective holes of the sieve, promoting a second cleaning phase of the latter and regulating the flow of water released by the showerhead, through one or more water outlets formed between each pin and the inner contour of the respective hole of the sieve.

The invention further proposes a construction capable of allowing the pins of the cleaning means to be jointly or individually displaced, axially and upwardly, to an inoperative position, in which the sieve holes are cleared off, by actuation of the user, with the showerhead in a full bath operation, so that the pressurized water flow, being admitted in the body of the showerhead, may carry out, with the sieve holes in a full on condition, an intense washing of said holes.

BRIEF DESCRIPTION OF THE DRAWINGS

The invention will be described below, with reference being made to the appended drawings, given by way of example of a possible embodiment of the invention and in which.

DESCRIPTION OF THE INVENTION

Figure 1:
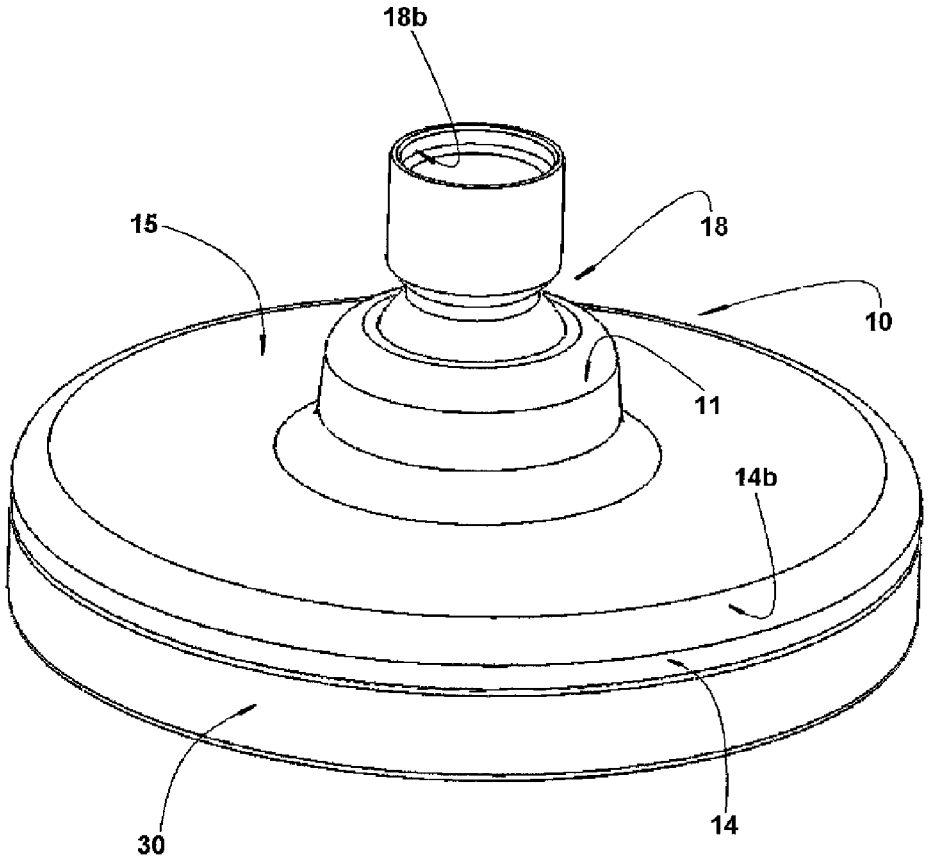
FIG. 1 represents an upper perspective view of the hollow body of the showerhead.
Figure 2:
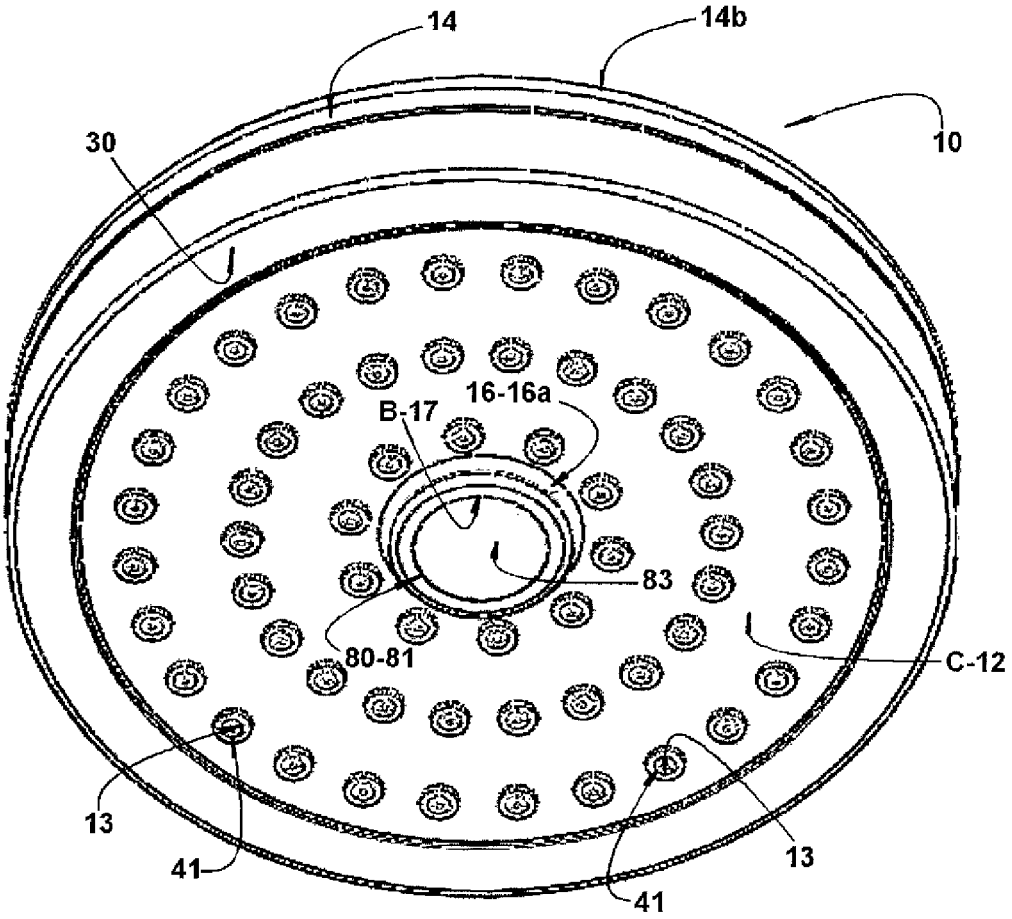
FIG. 2 represents a lower perspective view of the hollow body of a first embodiment of the showerhead, inferiorly closed by a sieve.

As already mentioned and illustrated in the appended drawings, the present showerhead comprises a hollow body 10 formed of any adequate material and provided with an inlet nozzle 11, to be coupled to a water supply pipe (not illustrated), and with a lower wall 12, defined by a sieve C perforated by a plurality of holes 13.

According to the two illustrated constructions, the hollow body 10 presents a lateral wall 14, generally cylindrical, but which may be square, rectangular, oval, etc., having a lower edge 14*a*, whose sealing, in relation to a peripheral region of the lower wall 12, is effected by an O'ring 20, and an upper edge 14*b* incorporating a peripheral region of an upper wall 15, wherefrom the inlet nozzle 11 projects outwards.

The inlet nozzle 11 may have the form of a tubular sleeve which is internally or externally threaded, so as to receive the end of the supply pipe (not illustrated), defining a rigid connection between the latter and the hollow body 10 of the showerhead.

In the illustrated constructions, the inlet nozzle 11 defines, internally, the housing for a spherical inner end 18*a* of a tubular connector 18, whose outer end 18*b* is configured to be threaded to the supply pipe.

The inlet nozzle 11 further presents an inner groove 11*a* in the interior of which is housed an O'ring 19, made of elastomer, in order to guarantee the sealing between the spherical inner end 18*a* and the inlet nozzle 11.

The particular way by which O'ring 19 is maintained in position in the interior of the inlet nozzle 11, will be described hereinafter.

The lower edge 14*a* of the lateral wall 14 presents a thread 14*c*, preferably (but not necessarily) external, in which is threaded a ring 30 for fixation of the sieve C in the hollow body 10.

According to the invention, the showerhead further comprises a cleaning means 40 mounted in the interior of the hollow body 10, carrying a plurality of downwardly projecting pins 41, the cleaning means 40 being displaceable between an inoperative position (FIGS. 3, 5, 7 and 9), in which it keeps the pins 41 away from the holes 13 of the sieve C, and an operative position, in which each pin 41 is introduced into a respective hole 13 of the sieve C (FIGS. 4, 6, 8 and 8A), defining at least one water outlet S, of reduced cross section, with the respective hole 13 in which the pin 41 is introduced. In the illustrated embodiments, the cleaning means 40 comprises a grid 42 guided in the interior of the hollow body 10 of the showerhead, during the displacement of the cleaning means 40, between its inoperative and operative positions, said grid 42 carrying a plurality of pins 41, incorporated in said grid 42 in a single piece, or optionally, a plurality de pins 41 mounted in respective windows 42*a* in the grid 42, so as to be axially displaced in relation to the latter, in the interior of said housings 45, by a distance slightly superior to the axial extension of each hole 13 of the sieve C.

One of the parts defined by the lower face of the cleaning means 40 and the upper face of sieve C may further incorporate a plurality of small eccentric axial projections 44 (see FIGS. 3, 4, 5, 8, 8A and 9), which are seated against the other of said parts, in order to maintain the grid 42 slightly spaced away from the sieve C, when conducted to the operative position.

The showerhead further comprises a driving means 50, operatively associated with the inlet nozzle 11 and affixed to the cleaning means 40, maintaining the latter in said inoperative position, while the hydraulic pressure in the interior of inlet nozzle 11 is inferior to a reference value, and displacing said cleaning means to the operative position, when said hydraulic pressure reaches the reference value.

An impelling means 60 is mounted in the interior of the hollow body 10, for displacing the driving means 50 and the cleaning means 40 to the inoperative position, when the hydraulic pressure in the interior of inlet nozzle 11 is inferior to said reference value.

In the constructive illustrated forms, the hollow body 10 is provided, in the interior of the inlet nozzle 11, with a conical seat 70, of tubular shape and preferably threaded in the interior of the inlet nozzle 11, and which projects downwardly from the upper wall 15 of the hollow body 10 and is also axially aligned with the inlet nozzle 11.

The conical seat 70 presents an outer end 71 open to the interior of the inlet nozzle 11, and an inner end 72 open to the interior of the hollow body 10. The outer end 71 of the conical seat 70 has the function of defining the lower axial retention of the O'ring 19, maintaining the latter pressed between the inlet nozzle 11 and the spherical inner end 18*a* of the tubular connector 18. In the embodiment illustrated in FIGS. 3, 4 and 5, the conical seat 70 is provided with a plurality of inner axial recesses 75, extending until the inner end 72 of the conical seat 70 and inferiorly open to respective lower radial recesses 76, also provided in the inner end 72 of the conical seat 70, in order to allow a restricted fluid communication between the inlet nozzle 11 and the interior of the hollow body 10, upon start of the showerhead operation.

Figure 8:
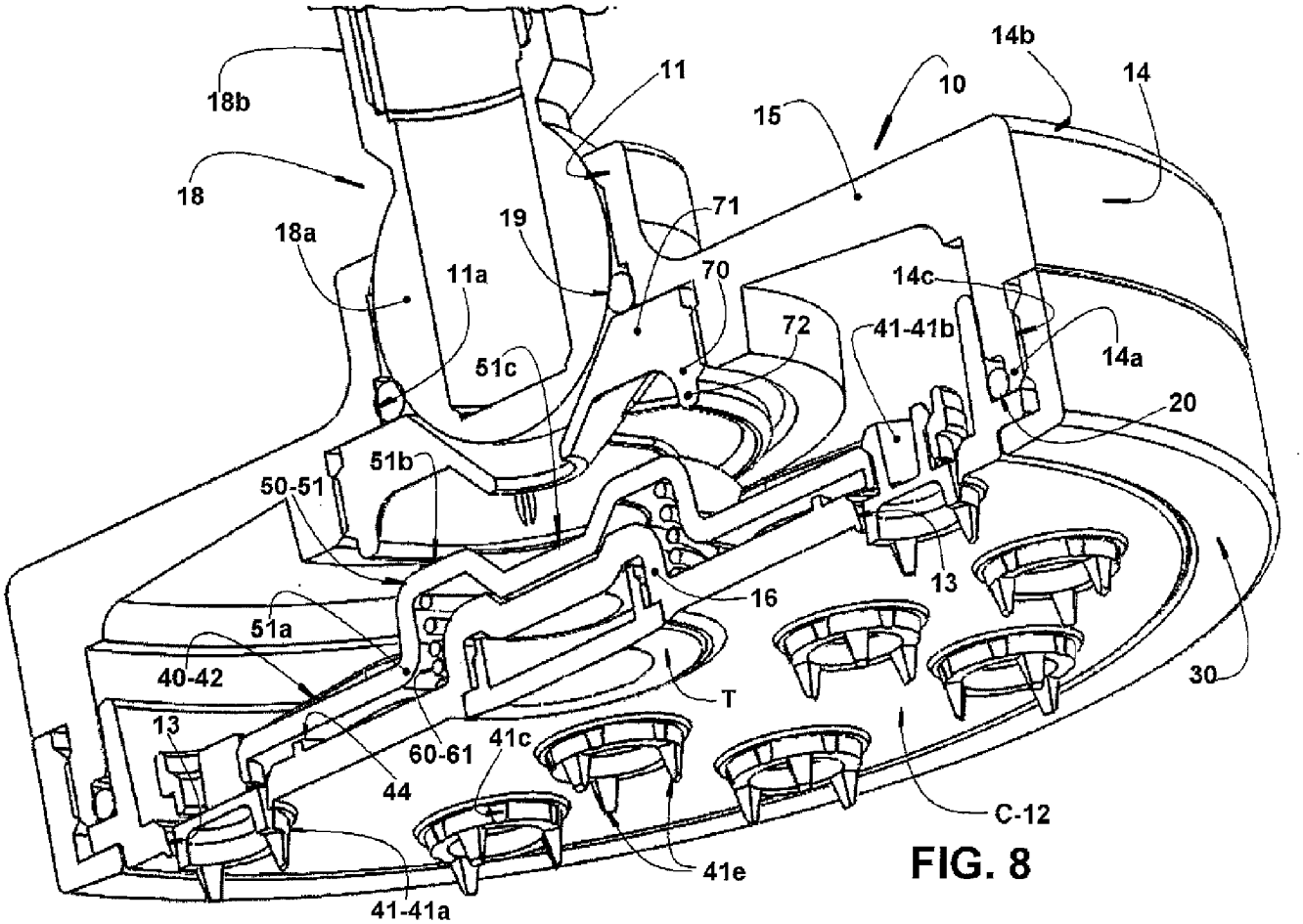
FIG. 8 represents a diametrically and vertically cut perspective view of the showerhead, of the second embodiment of the showerhead in the on condition, with the pins of the cleaning means in an operative position, inside the respective sieve holes.
Figure 8A:
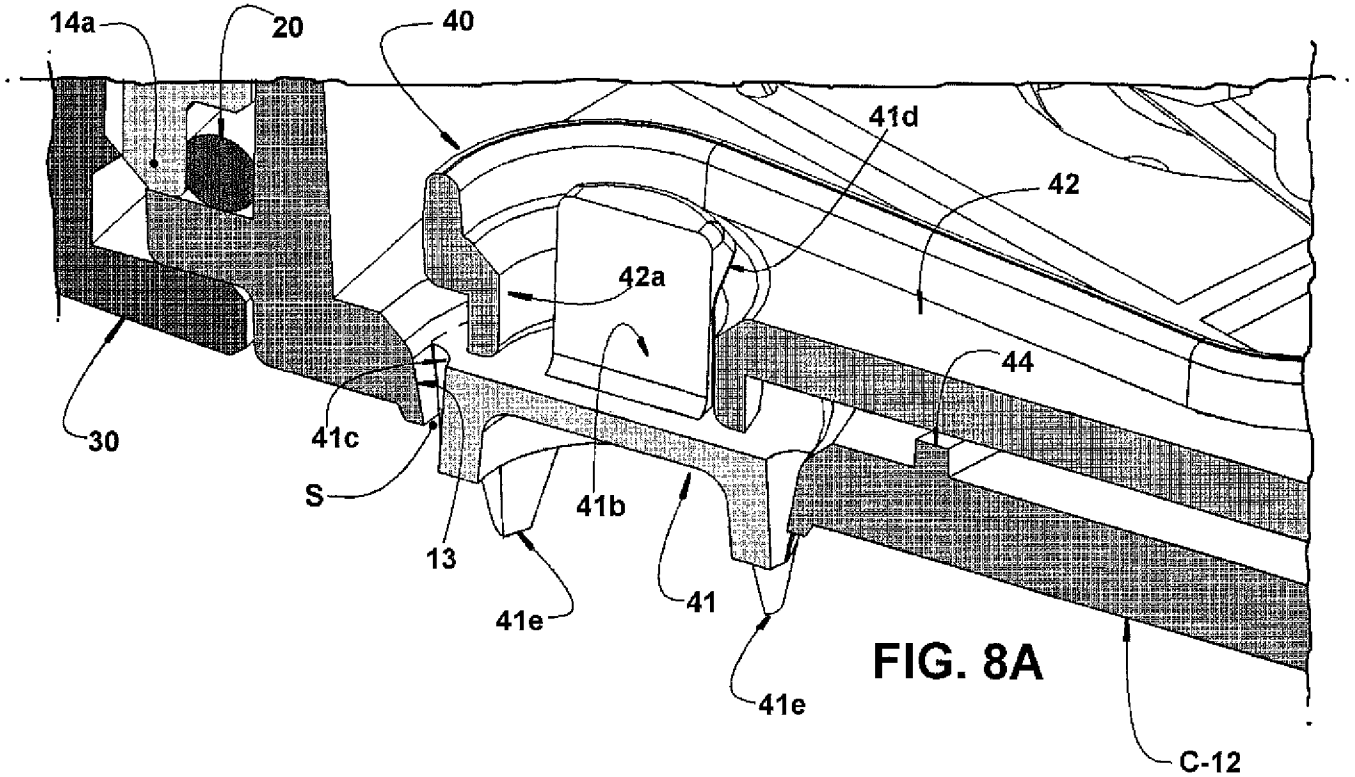
FIG. 8A represents an enlarged detail of part of FIG. 8.
Figure 9:
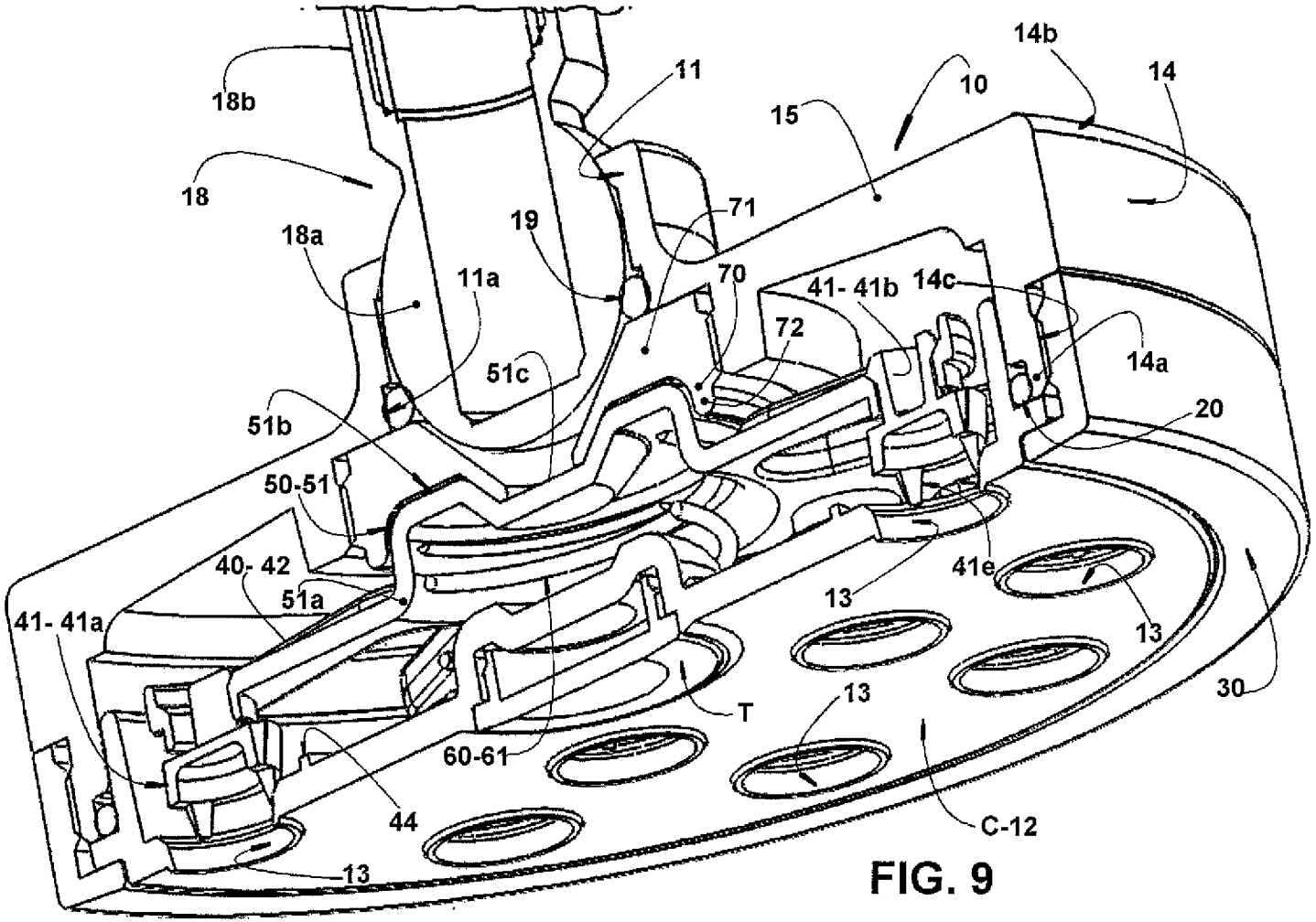
FIG. 9 represents a diametrically and vertically cut perspective view of the showerhead of FIG. 8, but in the off condition, with the pins of the cleaning means in an inoperative position, retracted in relation to the respective holes of the sieve.
Figure 10:
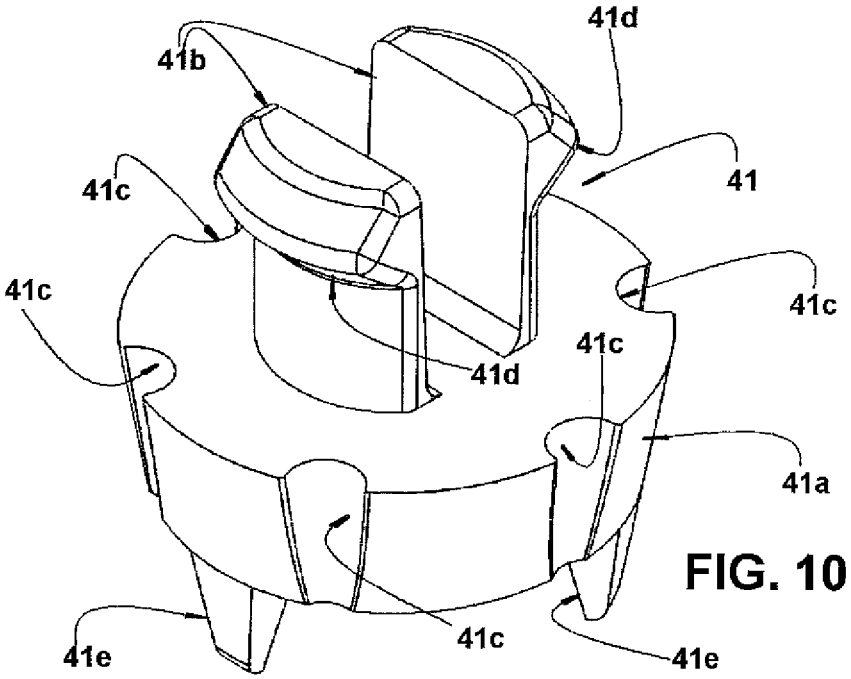
FIG. 10 represents an enlarged perspective view of the pins of the cleaning means.
Figure 11:
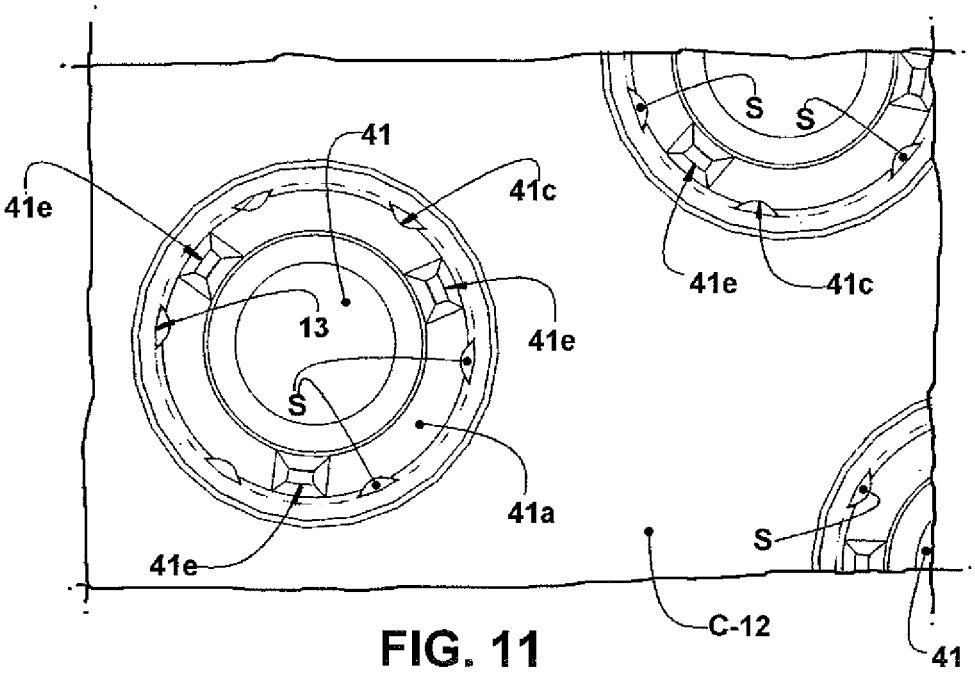
FIG. 11 represents a plan view of the pin illustrated in FIG. 10, when positioned in the interior of a respective hole of the sieve, according to the second embodiment of the invention.

In the embodiment illustrated in FIGS. 8, 8A and 9, the conical seat 70 has its lower end 72 configured to define, with the adjacent median portion of the grid 42, an annular gap which defines a restricted water passage between the inlet nozzle 11 and the interior of the hollow body 10, upon the start of the showerhead operation, that is, when turned on.

Figure 3:
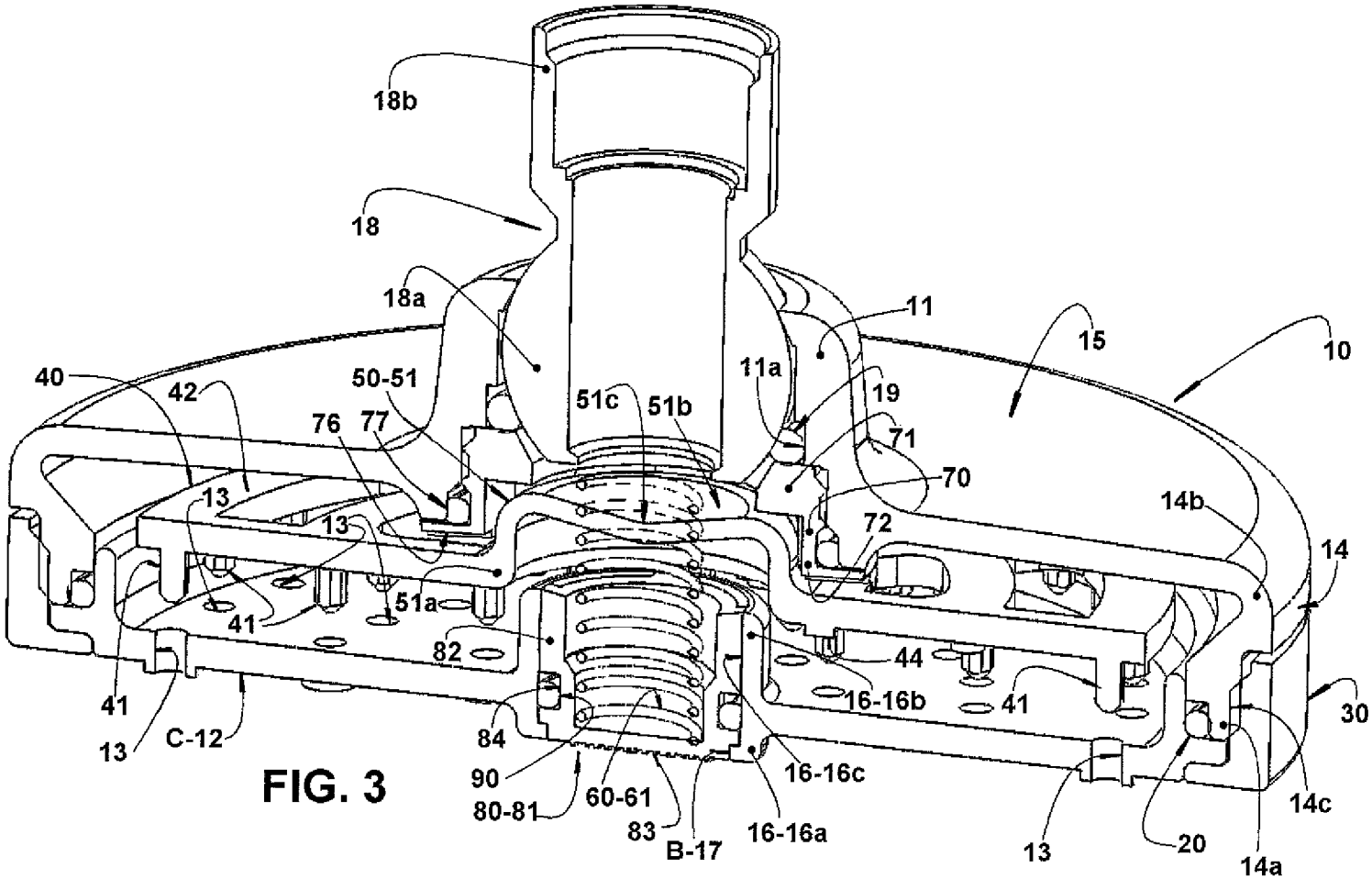
FIG. 3 represents a diametrically and vertically cut perspective view of the first embodiment of the showerhead in the turned off condition, with the cleaning means in the inoperative position.
Figure 4:
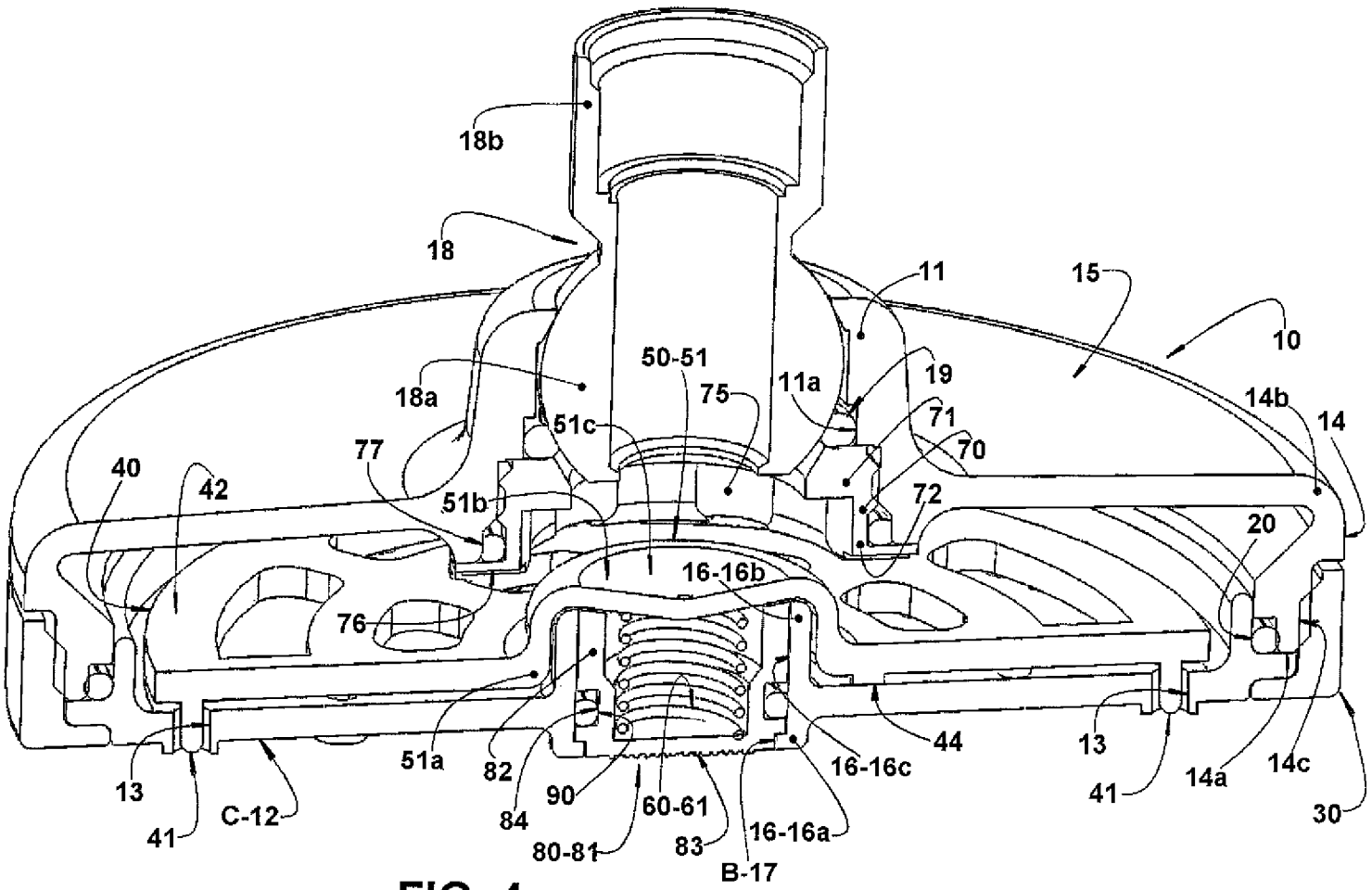
FIG. 4 represents a diametrically and vertically cut perspective view of the showerhead of FIG. 3, but in the fully turned on condition, with the cleaning means in the operative position.
Figure 5:
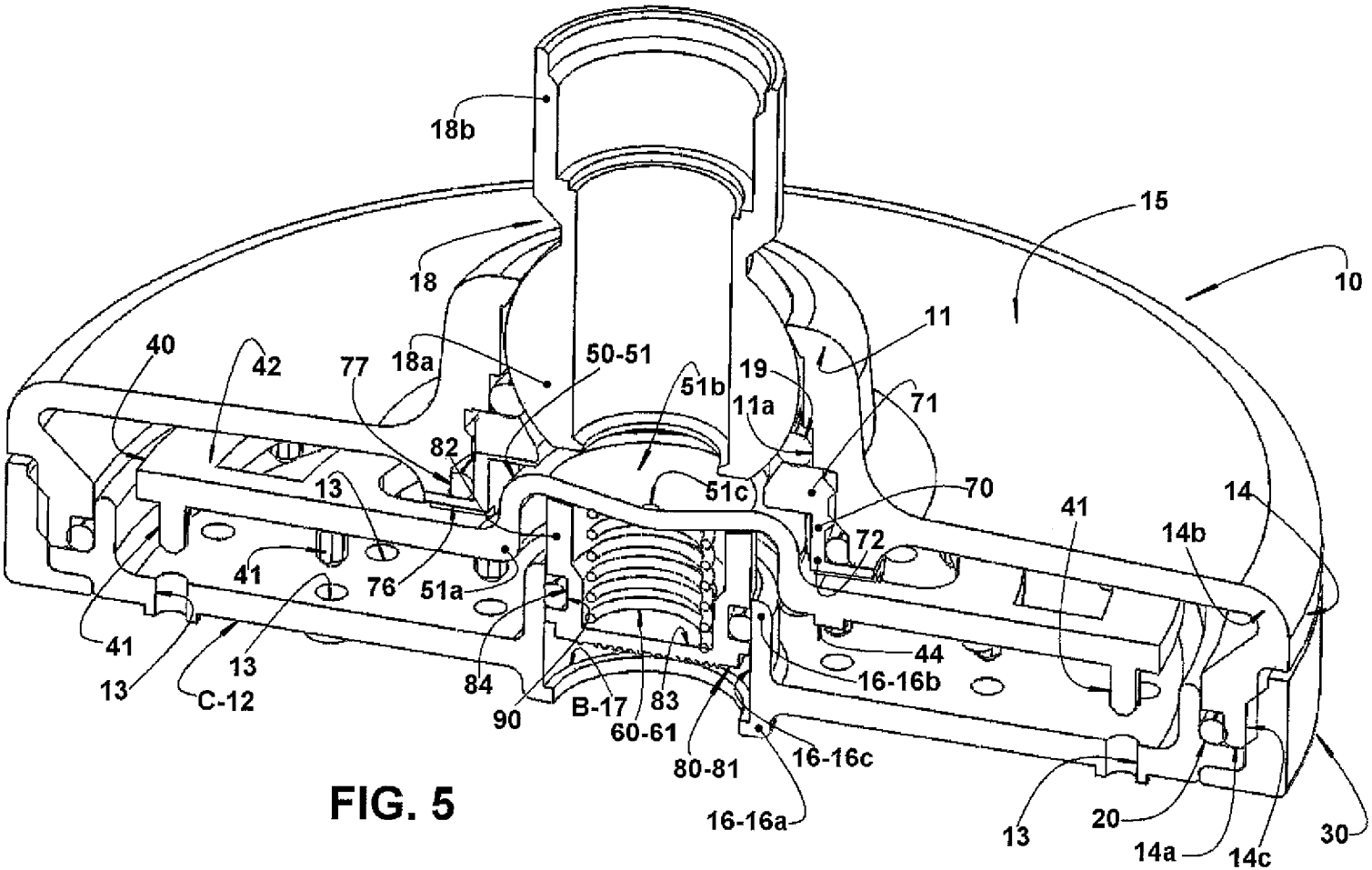
FIG. 5 represents a diametrically and vertically cut perspective view of the showerhead of FIGS. 3 and 4, in the fully turned on condition and with the cleaning means manually displaced to the inoperative position, allowing the full water flow being admitted in the hollow body of the showerhead to effect an intense operation of washing the sieve holes during the shower bath.
Figure 6:
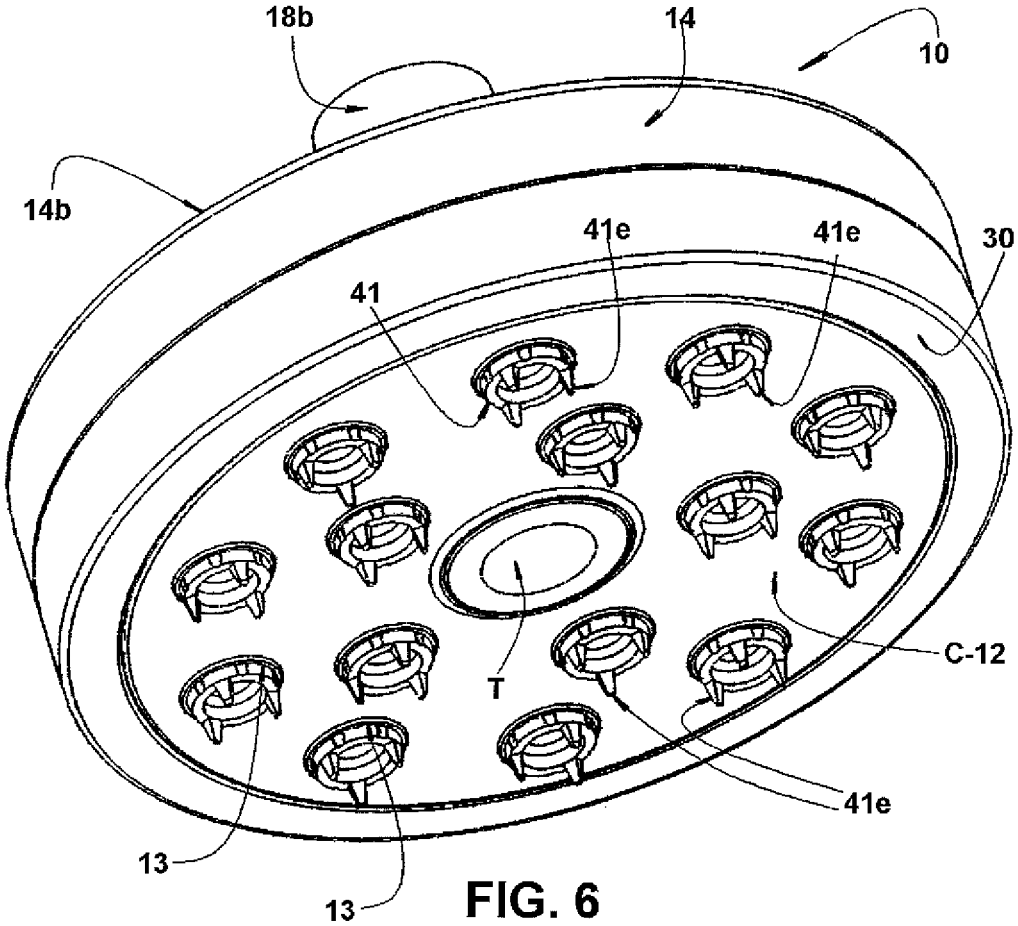
FIG. 6 represents a lower perspective view of the hollow body of a second embodiment of the showerhead, with the pins of the cleaning means in the operative position inserted in the interior of the respective sieve holes, with the showerhead in the on condition.
Figure 7:
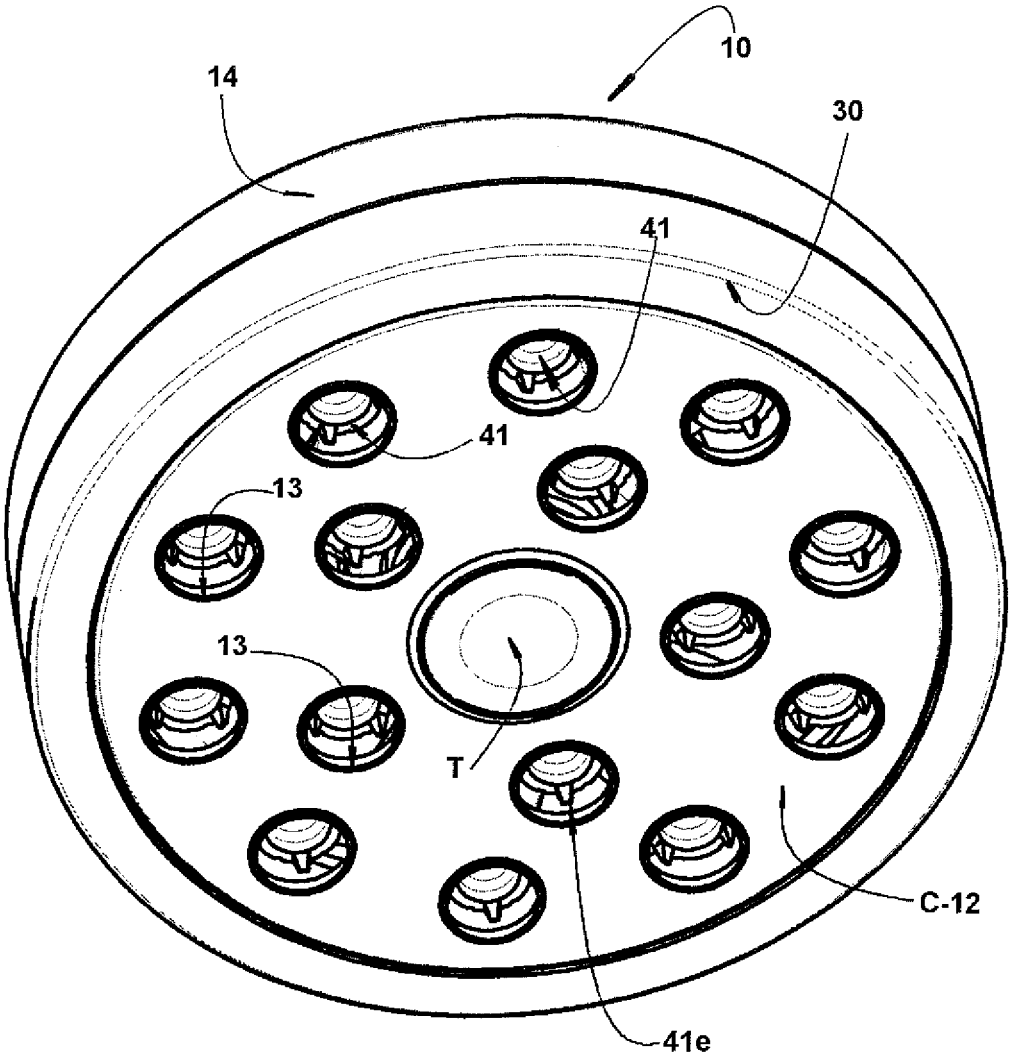
FIG. 7 represents a lower perspective view of the hollow body of the second embodiment of the showerhead, with the pins of the cleaning means being displaced to an elevated inoperative position, unblocking the sieve holes, with the showerhead in the off condition.

The driving means 50 comprises a piston 51 having a base end 51*a* affixed to the cleaning means 40 and a top end 51*b* presenting a median recess 51*c* which may present a inverted slightly conical recess, as illustrated in FIGS. 3, 4 and 5, or an inverted frusto-conical deeper recess, to cooperate with the conical seat 70, in the inoperative position of the cleaning means 40, as illustrated in FIGS. 8 and 9.

The piston 51 is axially displaced, in the interior of the hollow body 10, to displace the cleaning means 40 between its inoperative and operative positions, as a function of the hydraulic pressure in the interior of the inlet nozzle 11, that is, in the interior of the conical seat 70, upstream the piston 51.

In the embodiment illustrated in FIGS. 3, 4 and 5, the conical seat 70 and the piston 51 are constructed to allow a relatively restricted fluid communication between the inlet nozzle 11 and the interior of the hollow body 10, when the cleaning means 40 is in the inoperative position, illustrated in FIG. 3, and a complete fluid communication between the inlet nozzle 11 and the interior of the hollow body 10, when the cleaning means 40 is displaced to the operative position illustrated in FIG. 4.

In the embodiment illustrated in FIGS. 8 and 9, the conical seat 70 and the piston 51 are constructed for: eliminating any relevant fluid communication between the inlet nozzle 11 and the interior of the hollow body 10 when the cleaning means 40 is in the inoperative position, illustrated in FIG. 9; a partial fluid communication between the inlet nozzle 11 and the interior of the hollow body 10, when the cleaning means 40 is slightly downwardly displaced, as a function of the supply hydraulic pressure, allowing that a certain water flow reaches the holes 13 of the sieve C, before they receive the respective pins 41; and a full fluid communication between the inlet nozzle 11 and the interior of the hollow body 10, when the cleaning means 40 is displaced to the operative position illustrated in FIGS. 8 and 8A, with the pins 41 introduced in the respective holes 13 of the sieve C.

Thus, in both embodiments, upon start of the turn-on operation of the showerhead, the pressurization of the inlet nozzle 11 and of the conical seat 70 is made in a progressive way, remaining in values inferior to the reference value and which are insufficient to provoke displacement of the piston 51 and of the cleaning means 40 to the operative position of the latter, but allowing the water to be supplied to the holes 13 of the sieve C while the pressure in the inlet nozzle 11 remains inferior to the reference value.

During the time the cleaning means 40 remains in its inoperative position, with the impelling means 60 exerting, against the piston 51, a force superior to the opposite force produced by the hydraulic pressure in the interior of the conical seat 70, the water flow entering in the hollow body 10 will pass between the piston 51 and the inner end 72 of the conical seat 70, more precisely through the inner axial recesses 75 and lower radial recesses 76 of the conical seat 70, in the embodiment of FIGS. 1 to 5, reaching the holes 13 of the sieve C which are found completely free from the pins 41 of the cleaning means 40. This initial water flow, admitted in the showerhead, carries out the first cleaning phase, washing the holes 13 of the sieve C and dragging, to the outside of the hollow body 10, any solid impurity that might have been brought by the water supply system.

In order to make said first cleaning phase be a washing phase for the holes 13 of the sieve C, said holes present a cross section area, generally (but not necessarily) circular, larger than that required in the project, for each water outlet of the sieve C with the normal operation of the showerhead.

Thus, when the pins 41 are introduced into the holes 13, the free cross section area of the latter becomes sufficient and adequate to form the desired water flow to be released by the showerhead. The debris, if existing in the water flow admitted in the hollow body 10, are removed by the initial washing flow and drained through the holes 13 of the sieve C, which holes are dimensioned with a diameter much larger than that usually employed, minimizing the retention of particulate material in said holes 13.

With the continuous turning-on of the showerhead, the hydraulic pressure in the interior of the inlet nozzle 11 and of the conical seat 70 is elevated, until reaching the reference value, from which the force exerted by the impelling means 60 is overcome, allowing the piston 51 to be displaced toward the sieve C, dragging the cleaning means 40 to the operative position, in which the pins 41 are introduced in the respective holes 13, diminishing the free cross section of the latter to an area dimensioned so as to allow the adequate water discharge from the sieve C.

In the embodiment of FIGS. 1 to 5, the pins 41 are loosely introduced in the holes 13 of the sieve C, defining a single water outlet S, of annular shape, in the gap defined between the pin 41 and the inner wall of the respective hole 13. In this embodiment, the penetration of the pins 41 in the holes 13 also has the function of promoting a second cleaning phase of the sieve C, clearing the holes 13. Any residue penetrating in the interior of the hollow body 10 during its normal operation and being larger than the annular radial gap existing between each pin 41 and the respective hole 13, will be retained in the upper portion of the hole 13, without provoking the flow distortions observed in the prior art systems.

In the embodiment of FIGS. 6 to 11, the holes 13 of the sieve C have diameters even larger than those of the first embodiment, presenting an inverted slightly frusto-conical shape, each pin 41 presenting a body 41*a* with a correspondent frusto-conical shape so as to be fitted, with no gap, in the interior of a respective hole 13 of the sieve C, said body 41*a* carrying an upper neck 41*b*, to be mounted to the grid 42 of the cleaning means 40.

In said second embodiment, the body 41*a* of the pin 41 is provided with a plurality of outer axial grooves 41*c*, extended throughout the whole height of the body 41*a* and which define, each one, with the inner wall of the respective hole 13 of the sieve C, a water outlet S of the sieve C. Thus, after receiving the respective pin 41, each hole 13 of the sieve C is transformed into a plurality of water outlets S, increasing the sensation of abundant water during the bath, with a relatively reduced consumption of water in relation to the conventional solutions and even in relation to the solution defined in the first embodiment of the present invention.

In the referred second embodiment, each pin 41 has its tubular-shaped neck 41*b* fitted, with a small gap, through a respective window 42*a* provided in the grid 42 and incorporating a widened end 41*d* to be seated in a region of the upper face of the grid 42, defined around each window 42*a*. Thus, each pin 41 can be manually and individually upwardly displaced by the user of the showerhead, during the shower bath, in order to completely liberate the respective hole 13 of the sieve C, promoting a complete washing, not only of the hole 13 itself, but also of all the outer axial grooves 41*c* of the body 41*a* of the pin 41.

In order to guarantee that the pins 41 are adequately positioned in the interior of the respective holes 13 of the sieve C, upon displacement of the cleaning means 40 from the inoperative position to the operative position, mainly when the sieve C is positioned in an inclined plane (not horizontal), each pin 41 may incorporate at least one lower guide means which, in the case of the second embodiment illustrated in FIGS. 6 to 11, takes the form of a plurality of lower peripheral axial projections of the body 41*a* of the pin 41. The lower guide means 41*e* should present an axial length sufficient to remain partially fitted in the interior of the respective hole 13 of the sieve C when the pin 41 is individually, or jointly with the other pins 41, upwardly displaced to the inoperative position of the cleaning means 40.

At the end of the bath, after the showerhead is turned off, it occurs the depressurization of the conical seat and the displacement of the piston 51 and of the cleaning means 40, by action of the impelling means 60, to the inoperative position in which the holes 13 are freed from the pins 41, being open to receive a new washing when the showerhead is turned on again, or upon a manual displacement, either jointly or individually, of the pins 41 to the inoperative position of the cleaning means 40.

Still according to the illustrated embodiments, the impelling means 60 comprises a helical spring 61 having an end seated on the sieve C and an opposite end seated against one of the parts defined by the piston 51 and by the cleaning means 40. In a preferred way, the piston 51 presents a tubular shape, with its base end 51*a* open and turned to the sieve C. With this construction, the opposite end of the helical spring 61 is fitted in the interior of the piston 51 and seated under the top end 51*b*.

In the embodiment illustrated in FIGS. 1 to 5, the showerhead presents an optional construction, according to which the lower wall 12 incorporates a central tubular nozzle 16, having an outer end 16*a*, provided, internally, with a small annular flange 17 which defines a stop means B, and with an inner end 16*b* which projects to the interior of the body of the showerhead, through a tubular wall 16*c*, and against which is seated the top end 51*b* of the piston 51 when the cleaning means 40 is conducted to the operative position, with the showerhead under full operation, in the turned on condition. In said condition, the base end of the piston 51*a* is positioned around the tubular wall 16*c* of the central tubular nozzle 16.

In the interior of the central tubular nozzle 16 is slidingly mounted a plunger 80, preferably in the form of a cup 81, having a lateral wall 82, telescopically sliding in the interior of the central tubular nozzle 16, and a lower end wall 83 against which is seated an adjacent end of the impelling means 60 which, in the example illustrated, is defined by the helical spring 61. The lateral wall 82 of the cup 81 is provided with at least one peripheral groove 84, in which is lodged a sealing ring 90 in O'ring form, which is radially and slidingly pressed against the tubular wall 16*c* of the central tubular nozzle 16.

Such constructive variant allows the user to achieve, during the bath, and intense additional washing of the holes 13 of the sieve C. Therefore, the user only needs to promote a simple axial and ascending manual displacement of the plunger 80, in the interior of the central tubular nozzle 16, from an inactive position, in which it has its lower end wall 83 seated against the small annular flange 17, by actuation of the impelling means 60, to an active position, in which the lateral wall 82 of the plunger 80 is seated against the top end 51*b* of the piston 51 and displacing axially upwards the cleaning means 40 to its inoperative position, with its lower pins 41 being displaced to the outside of the holes 13 of the sieve C, allowing the pressurized water flow being admitted in the body of the showerhead to carry out an intense washing of said holes 13 of the sieve C, in which said holes 13 are in a full on condition and the showerhead is in a full bath operation.

The user then releases the manual force exerted on the plunger 80, for allowing the water pressure to push the cleaning means back to its operative position and the impelling means 60 to return the plunger 80 to its inactive position.

The user may carry out several operations of pressing and releasing the plunger 80, in order to provide multiple washing operations of the holes 13 of the sieve C during the shower bath.

As mentioned above in the illustrated constructions, the lower wall 12, which defines the sieve C, presents the central tubular nozzle 16 for housing the plunger 80. However, it should be understood that the lower wall 12 may be closed in the region of the central tubular nozzle which, in this case, is suppressed from the showerhead, the same occurring with the plunger 80. In said basic constructive option, the showerhead does not allow the user to carry out the operations of washing the sieve during the bath, that is, during operation of the showerhead.

It should be understood that the construction illustrated in FIGS. 6 to 11 may also present the same elements described in relation to the embodiment of FIGS. 1 to 5, so as to allow the user to displace all the pins 41 jointly, by displacing the same plunger mounted in an identical central tubular nozzle provided in the sieve C. In the embodiment illustrated in FIGS. 6 to 11, the central tubular nozzle 16 is found closed, internally, by a removable wall and, externally, by a cap T.

While only two embodiments of the invention have been illustrated herein, it should be understood that modifications in the form and arrangement of the component parts can be made, without departing from the inventive concept defined in the claims that accompany the present disclosure.

The invention claimed is:

1. A shower head, comprising a hollow body (10) having an inlet nozzle (11) connectable with a water supply pipe, and a lower wall (12) defined by a sieve (C) perforated by a plurality of holes (13); cleaning means (40) mounted in an interior of the hollow body (10), carrying a plurality of downwardly projecting pins (41) and displaceable between an inoperative position in which the plurality of pins (41) are spaced from the plurality of holes (13) in the sieve (C), and an operative position in which each of the plurality of pins (41) is introduced in a respective hole (13) of the plurality of holes in the sieve (C) and defines at least one outlet (S) with the respective hole (13); a conical seat (70) provided in the interior of the hollow body (10) and having an outer end (71) maintained in a constant fluid communication with the inlet nozzle (11), and an inner end (72) open to the interior of the hollow body (10), driving means (50) having a piston (51) provided with a base end (51*a*) affixed to the cleaning means (40) and a top end (51*b*) cooperating with the inner end (72) of the conical seat (70) in the inoperative position of the cleaning means (40) retaining the cleaning means (40) in the inoperative position thereof when a hydraulic pressure in an interior of the inlet nozzle (11) and the conical seat (70) upstream of the piston (51) is less than a reference value, and displacing the cleaning means (40) to the operative position thereof when the hydraulic pressure reaches the reference value; and biasing means (60) mounted in the interior of the hollow body (10) displacing the driving means (50), together with the cleaning means (40), to the inoperative position of the cleaning means (40) when the hydraulic pressure is less than the reference value.

2. The showerhead according to claim 1, wherein the conical seat (70) and the piston (51) allow a restricted fluid communication between the inlet nozzle (11) and the interior of the hollow body (10) when the cleaning means (40) is in the inoperative position, and a full fluid communication between the inlet nozzle (11) and the interior of the hollow body (10), when the cleaning means (40) is displaced to the operative position.

3. The showerhead according to claim 2, wherein the conical seat (70) is provided with a plurality of inner axial recesses (75), extended to the inner end (72) of the conical seat (70) and partially open to respective lower radial recesses (76), which are also provided in the inner end (72) of the conical seat (70), defining the restricted communication between the inlet nozzle (11) and the interior of the hollow body (10), upon start of the showerhead operation.

4. The showerhead according to claim 1, wherein the conical seat (70) and the piston (51) eliminate any fluid communication between the inlet nozzle (11) and the interior of the hollow body (10) when the cleaning means (40) is in the inoperative position, and provide a partial fluid communication between the inlet nozzle (11) and the interior of the hollow body (10), when the cleaning means (40) is initially displaced downwardly, as a function of the supply hydraulic pressure, and a full fluid communication between the inlet nozzle (11) and the interior of the hollow body (10), when the cleaning means (40) is displaced to the operative position, with the pins (41) introduced into the respective holes (13) of the sieve (C).

5. The showerhead according to claim 2, wherein the biasing means (60) comprises a helical spring (61) having one end seated on the sieve (C) and an opposite end seated against one of parts defined by the piston (51) and by the cleaning means (40).

6. The showerhead according to claim 5, wherein the piston (51) has a tubular shape with its base end (51*a*) open and turned to the sieve (C).

7. The showerhead according to claim 6, wherein the opposite end of the helical spring (61) is fit ted in the interior of the piston (51) and is seated 10 under the top end (51*b*) of the piston.

8. The showerhead according to claim 1, wherein the hollow body (10) has a lateral wall (14), having a lower edge (14*a*), against which is seated and affixed a peripheral region of the sieve (C), and an upper edge (14*b*) incorporating a peripheral region of an upper wall (15), the conical seat (70) being defined by a central projection descending from the upper wall (15).

9. The showerhead according to claim 8, wherein the lower edge (14*a*) of the lateral wall (14) has a thread (14*c*) to which a ring (30) for fixation of the sieve (C) is threaded.

10. The showerhead according to claim 1, wherein the cleaning means (40) comprises a grid (42) guided in the interior of the hollow body (10) of the showerhead and carrying the -downwardly projecting plurality of pins (41).

11. The showerhead according to claim 1, wherein the at least one water outlet (S), defined in each of the plurality of holes (13) of the sieve (C), when the cleaning means (40) is in the operative position, has a cross section area sufficient for the formation of a desired water flow to be released by the showerhead.

12. The showerhead, according to claim 1, wherein the lower wall (12) of the hollow body (10) incorporates a central tubular nozzle (16), having an outer end (16*a*) provided with a stop means (B) and an inner end (16*b*) against which is seated the driving means (50) when the cleaning means (40) is taken to its operative position, an interior of the central tubular nozzle (16) being slidingly mounted to a plunger (80), manually displaceable to an inactive position, in which the plunger is seated, by actuation of the biasing means (60), against the stop means (B), to an active position, with the plunger (80) seated against the driving means (50) and axially displacing the cleaning means (40) upwards and towards its inoperative position, against the action of the impelling means (60) and of the hydraulic pressure in the inlet nozzle (11).

13. The showerhead, according to claim 12, wherein the stop means (B), provided in the outer end (16*a*) of the tubular nozzle (16), is defined by an annular flange (17).

14. The showerhead, according to claim 12, wherein the plunger (80) is in form of a cup (81) comprising a lateral wall (82), telescopically sliding in the interior of the central tubular nozzle (16), and a lower end wall (83) against which is seated an adjacent end of the biasing means (60).

15. The showerhead, according to claim 14, wherein the inner end (16*b*) of the central tubular nozzle (16) projects, to the interior of the hollow body (10) of the showerhead, through a tubular wall (16*c*), the lateral wall (82) of the cup (81) being provided with at least one peripheral groove (84) in which is housed a sealing ring (90), which is radially and slidingly pressed against the tubular wall (16*c*).

16. The showerhead, according to claim 1, wherein the plurality of pines (41) are loosely introduced in the plurality of holes (13) of the sieve (C), defining the at least one water outlet (S), of annular shape, in a gap defined between the pin (41) and an inner wall of the respective hole (13).

17. The showerhead, according to claim 1, wherein the plurality of holes (13) of the sieve (C) present an inverted frusto-conical shape, each pin (41) presenting a body (41*a*) with a corresponding frusto-conical shape to be fitted, with no gap, in an interior of a respective hole (13) of the sieve (C), said body (41*a*) carrying an upper neck (41*b*), to be mounted to the cleaning means (40), the body (41*a*) being provided with a plurality of outer axial grooves (41*c*), which define, each one, with an inner wall of the respective hole (13) of the sieve (C), the at least one water outlet (S).

18. The showerhead, according to claim 17, wherein each of the plurality of pins (41) has the upper neck (41*b*) thereof fitted, with a gap, through a respective window (42*a*) provided in a grid (42) and incorporating an end widening (41*d*) to be seated on the cleaning means (40), each pin (41) being manually and individually upwardly displaceable, in order to completely release the respective hole (13) of the sieve (C).

19. The showerhead, according to claim 1, wherein each pin (41) incorporates at least one lower guide means (41*e*) in the form of least one lower axial projection of the body (41*a*) of the pin (41) and having an axial length sufficient to remain partially fitted in the interior of the respective hole (13) of the sieve (C) when the pin (41) is found in the inoperative position of the cleaning means (40).

* * * * *